US009272843B2

(12) United States Patent
Parker

(10) Patent No.: US 9,272,843 B2
(45) Date of Patent: Mar. 1, 2016

(54) INTERMEDIATE CONTAINER WITH SIDE ARM SLIDE INSIDE OF THE CONTAINER

(71) Applicant: The Curotto-Can, LLC, Chattanooga, TN (US)

(72) Inventor: Brian T. Parker, Signal Mountain, TN (US)

(73) Assignee: The Curotto-Can, LLC, Chattanooga, TN (US)

( * ) Notice: Subject to any disclaimer, the term of this patent is extended or adjusted under 35 U.S.C. 154(b) by 218 days.

(21) Appl. No.: 14/043,393

(22) Filed: Oct. 1, 2013

(65) Prior Publication Data

US 2015/0093220 A1 Apr. 2, 2015

(51) Int. Cl.
*B65F 3/02* (2006.01)
*B65F 3/04* (2006.01)

(52) U.S. Cl.
CPC ..... *B65F 3/041* (2013.01); *B65F 2003/023* (2013.01); *B65F 2003/0276* (2013.01); *B65F 2003/0279* (2013.01)

(58) Field of Classification Search
CPC ..... B65F 2003/023; B65F 2003/0276; B65F 2003/0279; B65F 3/041; B65F 3/046; B65F 3/02; B65F 1/122; B65F 2003/0266
See application file for complete search history.

(56) References Cited

U.S. PATENT DOCUMENTS

| | | | | |
|---|---|---|---|---|
| 3,136,436 | A | | 6/1964 | Erlinder et al. |
| 4,219,298 | A | | 8/1980 | Stragier et al. |
| 4,313,707 | A | | 2/1982 | Bingman et al. |
| 4,669,940 | A | | 6/1987 | Englehardt et al. |
| 5,049,026 | A | | 9/1991 | Bingman et al. |
| 5,092,731 | A | | 3/1992 | Jones et al. |
| RE34,292 | E | | 6/1993 | Bingman et al. |
| 5,230,393 | A | | 7/1993 | Mezey |
| 5,607,277 | A | * | 3/1997 | Zopf ..... 414/408 |
| 5,651,654 | A | * | 7/1997 | Christenson ..... 414/408 |
| 5,702,225 | A | | 12/1997 | Ghibaudo |
| 5,797,715 | A | * | 8/1998 | Christenson ..... 414/408 |
| 5,931,628 | A | * | 8/1999 | Christenson ..... 414/408 |
| 6,491,489 | B1 | | 12/2002 | Stragier |
| 6,494,665 | B1 | | 12/2002 | Bingman |
| 6,722,839 | B2 | | 4/2004 | Bingman |
| 7,210,890 | B2 | | 5/2007 | Curotto et |
| 7,390,159 | B2 | | 6/2008 | Rimsa et al. |
| 7,553,121 | B2 | | 6/2009 | Curotto et al. |
| 7,559,734 | B2 | | 7/2009 | Khan et al. |
| 7,559,735 | B2 | | 7/2009 | Pruteanu et al. |
| 8,092,141 | B2 | | 1/2012 | Curotto et al. |
| 8,330,059 | B2 | * | 12/2012 | Curotto ..... 177/136 |
| 8,496,427 | B2 | | 7/2013 | Curotto et al. |
| 8,550,764 | B2 | | 10/2013 | Rowland et al. |
| 2002/0154973 | A1 | | 10/2002 | Bradshaw et al. |
| 2006/0280582 | A1 | | 12/2006 | Kouri |
| 2012/0273498 | A1 | * | 11/2012 | Curotto ..... 220/495.06 |
| 2013/0195590 | A1 | * | 8/2013 | Goedken ..... 414/408 |

* cited by examiner

*Primary Examiner* — Saul Rodriguez
*Assistant Examiner* — Mark Hageman
(74) *Attorney, Agent, or Firm* — Harness, Dickey & Pierce, P.L.C.

(57) ABSTRACT

A refuse collection container has a box shape. A movable arm is movably mounted on the container. The movable arm grasps refuse cans and dumps the refuse cans into the container. A slot is formed on a rear wall of the container to enable a portion of the arm to extend through the container. The arm is positioned adjacent the slot such that a movable portion of the arm is positioned inside of the container. The arm moves horizontally in and out of the container to grasp and return refuse cans.

11 Claims, 4 Drawing Sheets

INTERMEDIATE CONTAINER WITH SIDE ARM SLIDE INSIDE OF THE CONTAINER

FIELD

The present disclosure relates to front loading refuse vehicles and, more particularly, to an intermediate container that includes a side arm that is mounted partially inside the intermediate container.

BACKGROUND

Various types of intermediate cans or containers have been disclosed in the art. U.S. Pat. Nos. 8,496,427; 8,092,141; 7,553,121; and 7,210,890 are examples of such intermediate containers. These intermediate containers are known in the art as "Curotto Cans". Generally, Curotto cans include a side loading robotic arm at the rear or front of the container. This arm is movable on a slide that is secured on an outer wall of the container. While these types of side loading arms on intermediate containers work satisfactorily for their intended purposes, designers strive to improve the art.

Accordingly to the present disclosure, an intermediate container is provided with a sliding arm positioned within the container. The sliding portion of the arm is positioned within a pocket or a channel within the container. Generally, the side arm is positioned on the rear wall of the container.

SUMMARY

Accordingly to a first aspect of the disclosure, a refuse collection container comprises a bottom, a front wall, a rear wall and a pair of side walls between the front and rear walls to form an overall box shaped container. A movable arm is movably mounted on the container. The movable arm grasps refuse cans and dumps the refuse cans into the container. A slot is formed in the rear wall. The movable arm is positioned adjacent the slot. A slide portion of the arm is positioned on the inside of the container. The arm slide moves laterally (horizontally) in and out of the container to move the arm to grasp and return the refuse can. A portion of the arm projects through the wall and is on the outside of the container. An arm slide is positioned inside the container adjacent the slot. A grasping mechanism is positioned outside of the container. A channel is formed inside of the container to receive the slide mechanism. A protecting cover is coupled with the rear wall surrounding the arm slide.

According to a second aspect of the disclosure, a refuse vehicle comprises a chassis with a cab. A permanent container is coupled with the chassis. A front loading fork is coupled with the chassis. An intermediate container is mounted on the front loading fork. The intermediate collection container comprises a bottom, a front wall, a rear wall and a pair of side walls between the front and rear walls to form an overall box shaped container. A movable arm is movably mounted on the container. The movable arm grasps refuse cans and dumps the refuse cans into the intermediate container. A slot is formed in the rear wall. The movable arm is positioned adjacent the slot such that a slide portion of the arm is positioned on the inside of the container. The slide portion moves laterally in and out of the container to move the arm to grasp and return the refuse can. A portion of the arm projects through the wall and is on the outside of the container. An arm slide is positioned inside the container adjacent the slot. A grasping mechanism is positioned outside of the container. A channel is formed inside of the container to receive the slide mechanism. A protecting cover is coupled with the rear wall surrounding the slide.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
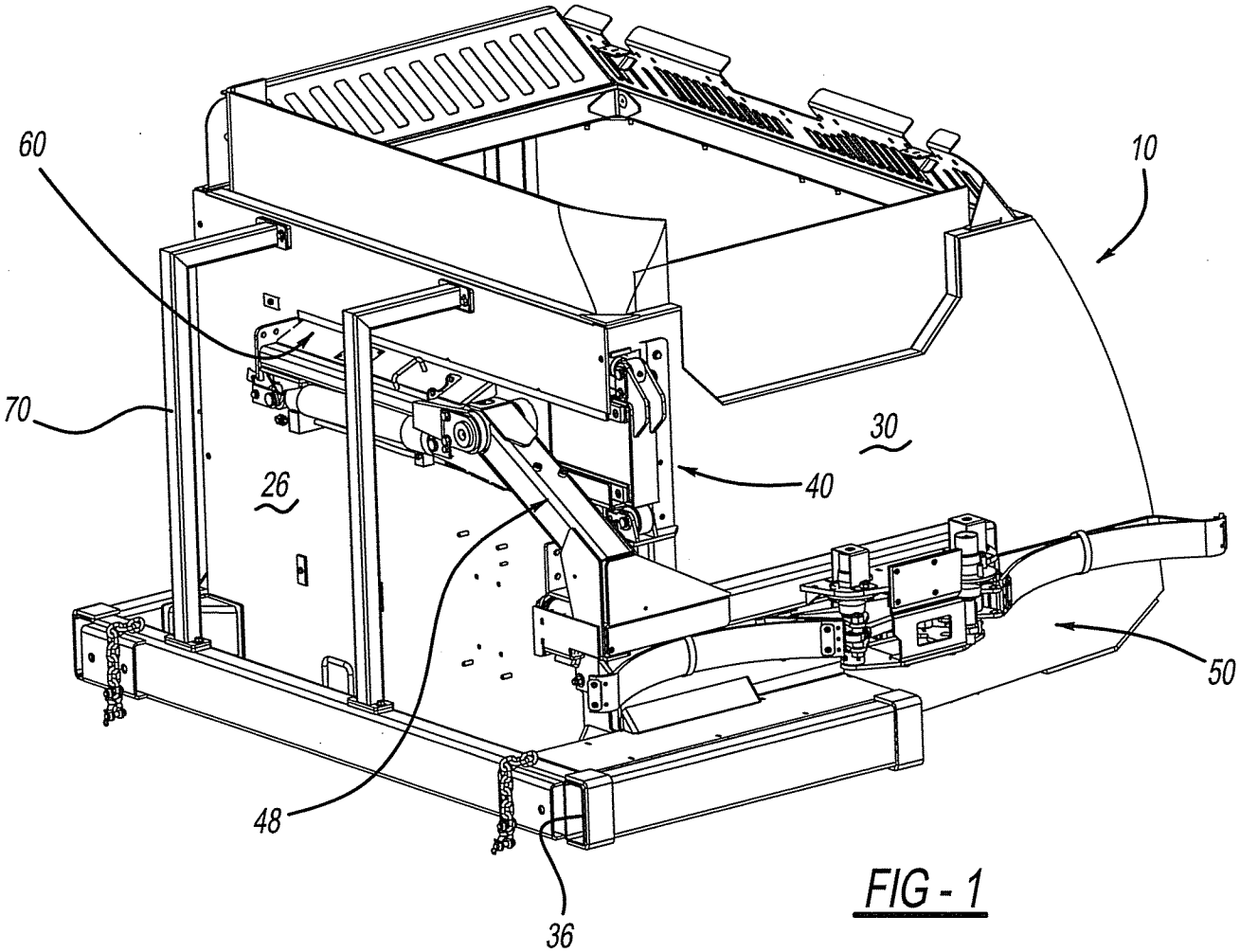
FIG. 1 is a rear perspective view of an intermediate container.

Turning to the figures, an intermediate container is illustrated and designated with the reference numeral 10. The intermediate container 10 is positioned on the front loading forks 12 of a refuse collection vehicle 14. The refuse collection vehicle 14 includes a cab 16 and a chassis 18 with a stationary container 20 mounted on the chassis 18 of the vehicle 14. The stationary container 10 has an opened hopper 22 that receives refuse from the intermediate container 10.

The intermediate container 10 has an overall box shape with a front wall 24, a rear wall 26, sidewalls 28, 30, a bottom 32 and an open top 34. A refuse can be positioned into the intermediate container 10 through the open top 34. The refuse remains in the intermediate container 10 until it dumped into the hopper 22. Also, the intermediate container 10 includes a pair of channels 36 that enable the forks 12 to pass therethrough to enable lifting and transporting of the intermediate container 10.

Figure 2:
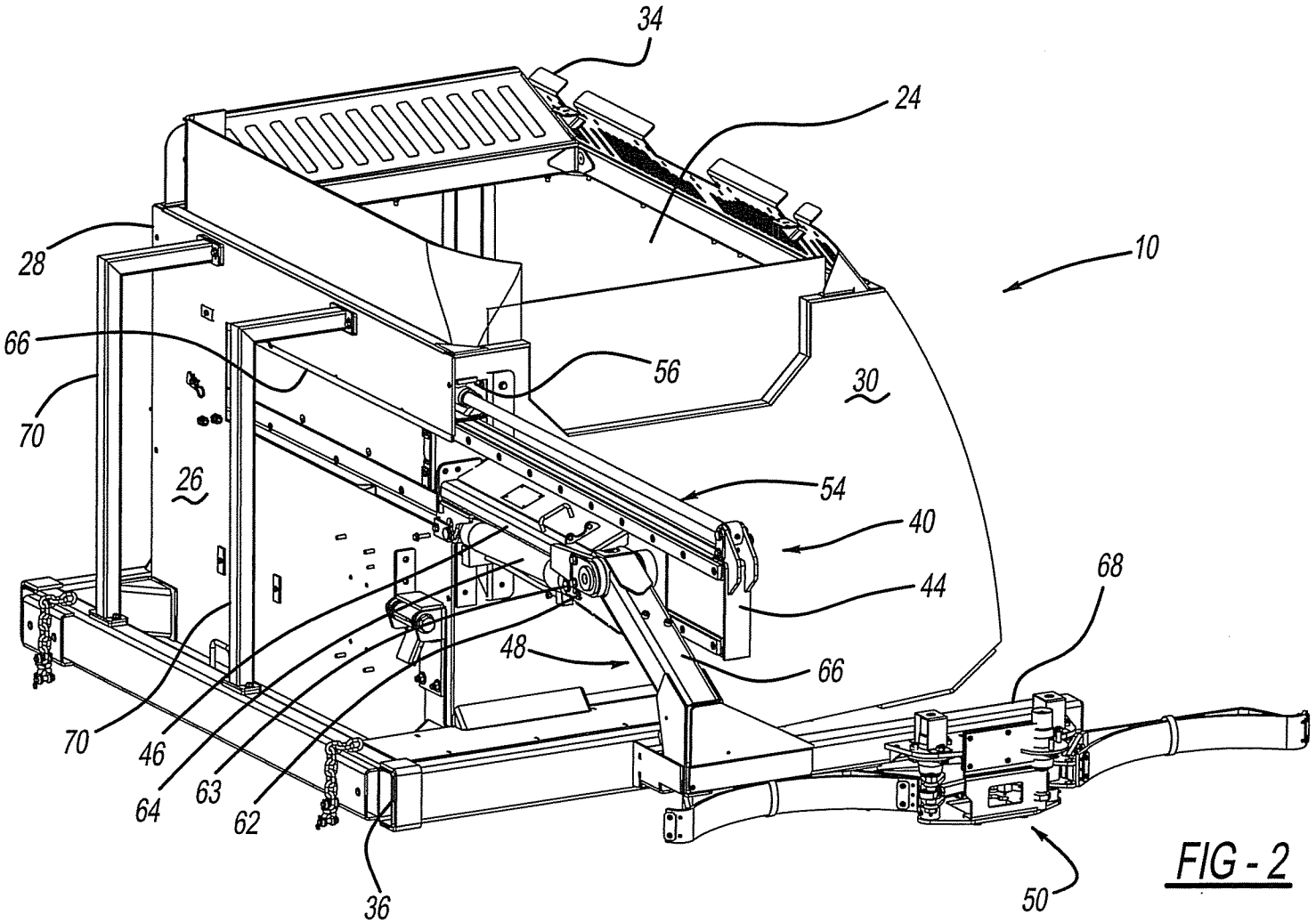
FIG. 2 is a view like FIG. 1 with the grasping arm extended.
Figure 3:
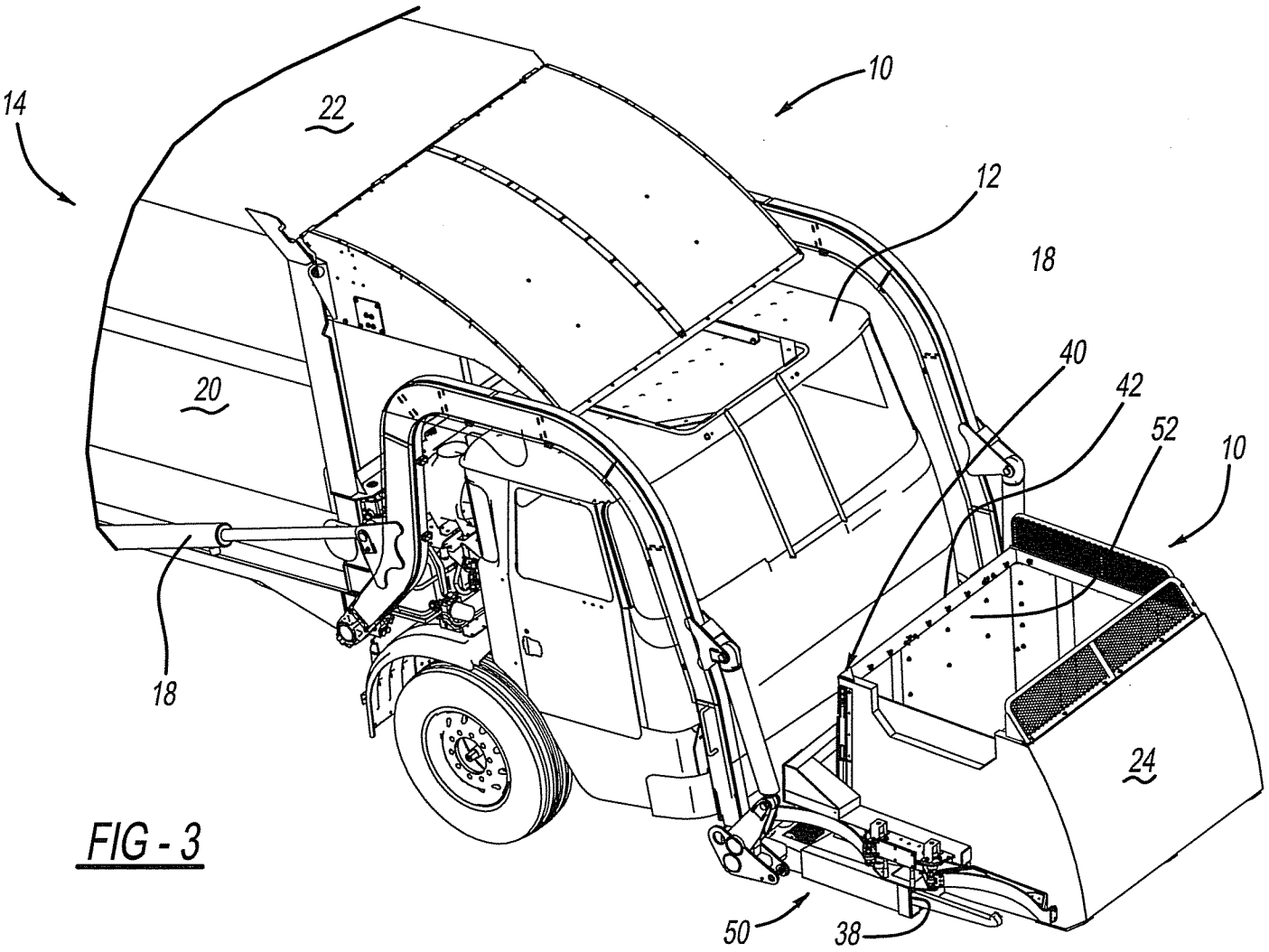
FIG. 3 is a front perspective view of the container of FIG. 1.
Figure 4:
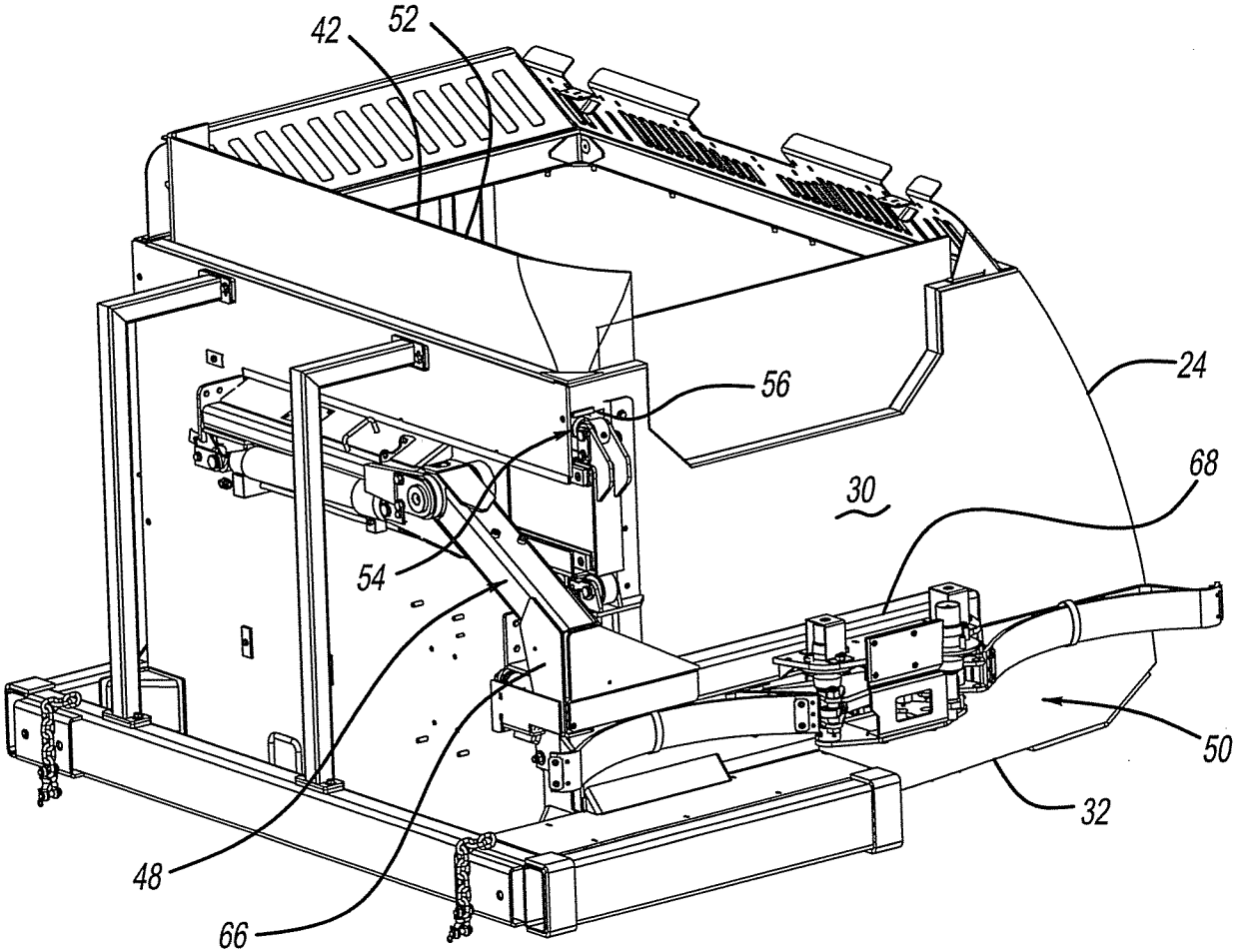
FIG. 4 is a view like FIG. 3 with the grasping arm in an extended position.

The collection arm 40 is coupled with the intermediate container 10. The collection arm 40 is mounted with a portion of the collection arm 40 positioned inside of the container 10. The collection arm 40 includes a housing 42, a slide member 44, a bracket 46, a frame 48 and a grabber assembly 50. The arm assembly housing 42 is secured to the inside of the rear wall 26. The housing 42 includes a cover 52 that surrounds the housing 42 prohibiting refuse from contacting the slide member 44. The housing 42 is secured with the inside of the rear wall 26. The cover 52 is secured with the housing 42 and rear wall and protects the slide arm 44 against the refuse. The housing 40 and cover 52 form a channel or pocket 56 for the slide arm 44. The slide arm 44 slides horizontally in the channel 56 provided by the housing and the cover 52. A cylinder 54 is coupled with the housing 40 or the rear wall 26 and also with the slide arm 44. The cylinder 54 enables the slide arm 44 to extend from the intermediate container 10 as illustrated in FIG. 2.

A slot 60 is formed in the rear wall of the intermediate container 10. The slot 60 enables the bracket 46 attached to the slide arm 44 to extend outside of the container 10. The bracket 46 includes a clevis 62 that receives a pin 63 and the portion of the frame 48. A hydraulic cylinder 64 is coupled between the bracket 46 and the clevis 62 to rotate the frame 48 with respect to the pivot pin 63.

The frame 48 has an L shape. One leg 66 is attached to the bracket clevis 62. The other leg 68 is mounted with the grabber assembly 50.

Protective members 70 project from the outside of the rear wall 26. They are positioned between the rear wall 26 and the refuse vehicle 14. The members 70 protect the arm assembly 40 from damage.

By having the slide arm 44 positioned within the container 10, this enables a more streamline arm assembly 40 reducing the width of the arm assembly 40 in the portion that extends from the rear wall 26 of the intermediate container 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A refuse collection container comprising:

a bottom, a front wall, a rear wall and a pair of side walls between the front and rear walls forming the container, the container defining an interior surface and an exterior surface, the interior surface defining an interior volume for receiving refuse;

a movable arm for grasping refuse cans and dumping the refuse cans into the container interior volume, the movable arm mounted on the container;

an aperture formed in the rear wall between the interior and exterior surfaces, the movable arm positioned adjacent the aperture such that a movable portion of the arm is positioned inside of the container, the movable portion of the arm moves horizontally in and out of the container to move the arm to grasp and return the refuse can; and a portion of the arm projecting through the aperture in the rear wall and the portion of the arm is positioned adjacent the exterior surface of the rear wall outside of the container interior volume.

2. The refuse collection container of claim 1, wherein the movable portion of the arm is an arm slide positioned inside the container adjacent the aperture.

3. The refuse collection container of claim 1, wherein a grasping mechanism is positioned outside of the container.

4. The refuse collection container of claim 1, wherein a channel is formed inside of the container for receiving the movable portion of the arm.

5. The refuse collection container of claim 1, wherein a protecting cover is coupled with the rear wall surrounding the movable portion of the arm.

6. A refuse vehicle and an intermediate container comprising:

a chassis with a cab;

a permanent container coupled with the chassis;

a front loading fork coupled with the chassis;

an intermediate container mounted on the front loading fork;

a bottom, a front wall, a rear wall and a pair of side walls between the front and rear walls forming the container, the container defining an interior surface and an exterior surface, the interior surface defining an interior volume for receiving refuse;

a movable arm for grasping refuse cans and dumping the refuse cans into the intermediate container interior volume, the movable arm mounted on the intermediate container;

an aperture formed in the rear wall between the interior and exterior surfaces, the movable arm positioned adjacent the aperture such that a movable portion of the arm is positioned inside of the intermediate container, the movable portion of the arm moves horizontally in and out of the intermediate container to move the arm to grasp and return the refuse can; and a portion of the arm projecting through the aperture in the rear wall and the portion of the arm is positioned between the refuse vehicle and exterior surface of the rear wall outside of the container.

7. The refuse collection container of claim 6, wherein the movable portion of the arm is an arm slide positioned inside the intermediate container adjacent the aperture.

8. The refuse collection container of claim 6, wherein a grasping mechanism is positioned outside of the intermediate container.

9. The refuse collection container of claim 6, wherein a channel is formed inside of the intermediate container for receiving the movable portion of the arm.

10. The refuse collection container of claim 6, wherein a protecting cover is coupled with the rear wall surrounding the movable portion of the arm.

11. The refuse collection container of claim 10, wherein the protecting cover and rear wall form a channel to receive the movable portion of the arm.

* * * * *